US006637068B2

(12) United States Patent
Crevling, Jr. et al.

(10) Patent No.: US 6,637,068 B2
(45) Date of Patent: Oct. 28, 2003

(54) FLOAT ROD SEAL FOR VACUUM CLEANER

(75) Inventors: Robert L. Crevling, Jr., Cogan Station, PA (US); Mark E. Baer, Trout Run, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/949,216

(22) Filed: Sep. 7, 2001

(65) Prior Publication Data

US 2003/0046790 A1 Mar. 13, 2003

(51) Int. Cl.[7] ..... A47L 9/00
(52) U.S. Cl. ..... 15/353; 15/327.6; 15/339
(58) Field of Search ..... 15/353, 327.6, 15/339; 96/406, FOR 107

(56) References Cited

U.S. PATENT DOCUMENTS 2,791,964 A * 5/1957 Reeve ..... 15/353
3,593,575 A * 7/1971 Thieme ..... 73/199
4,047,048 A * 9/1977 Demido ..... 200/84 R
4,098,307 A * 7/1978 Taylor ..... 137/614.21
5,918,344 A 7/1999 Crevling, Jr. et al. ..... 15/339
6,009,596 A 1/2000 Buss et al. ..... 15/353
6,069,330 A 5/2000 Crevling, Jr. et al. ..... 200/84 R

* cited by examiner

*Primary Examiner*—Theresa T. Snider
(74) *Attorney, Agent, or Firm*—Marshall, Gerstein & Borun, LLP

(57) ABSTRACT

A vacuum cleaner is provided having a tank with an inlet for receiving liquid material and defining an interior. An air impeller housing has an opening in air flow communication with the tank interior, and an air impeller is disposed inside the air impeller housing. A motor is disposed inside a motor housing and operatively coupled to the air impeller, and a switch is provided having a first position in which power is provided to the motor and a second position in which power to the motor is interrupted. A float is disposed in the tank and a float rod extends between the tank and the switch, the float rod being capable of moving the switch from the first position to the second position. A seal is positioned intermediately along the float rod to create a water-tight barrier between opposite ends of the float rod.

22 Claims, 5 Drawing Sheets

FLOAT ROD SEAL FOR VACUUM CLEANER

FIELD OF THE INVENTION

The present invention relates to vacuum cleaners, and more particularly to wet/dry vacuum cleaners.

BACKGROUND ART

Tank-type vacuum cleaners are capable of receiving dry materials such as debris or dirt and may also be used for suctioning liquids. Such vacuum cleaners typically include an air impeller disposed inside an air impeller housing that is in fluid communication with an interior of the tank, thereby to create a low pressure area in the tank for vacuuming both dry materials and liquid. A motor is operatively coupled to the air impeller. While some wet/dry vacuum cleaners are provided with a pump to facilitate emptying liquid from the tank, such a pump is not required during normal vacuum operation of the vacuum cleaner.

Whether or not the vacuum cleaner includes a pump, once the liquid level in the tank reaches a maximum height, it is important to prevent additional liquid from entering the tank. Accordingly, it is known to provide a switch for stopping the motor in response to a high liquid level. A float is typically provided inside the tank for detecting the liquid level in the tank, and a float rod extends between the float and an actuator for the switch. Accordingly, as the float is raised in response to increasing liquid level, the float rod also moves to actuate the switch, thereby to turn the motor off.

The float rod creates a path from the tank to the switch. Because the switch is often located with or near the motor, and the risk exists that liquid may reach the switch, motor, or other electrical components. For example, if the high liquid level switch fails, the liquid level in the tank may reach the air impeller, which may expel the liquid under significant force. Such liquid may follow the float rod path to the switch or motor. In addition, if the tank is tipped, the liquid may flow along the float rod path to the switch, motor, or other electrical components.

SUMMARY OF THE INVENTION

In accordance with the teachings of the present invention, a vacuum cleaner is provided having a tank with an inlet for receiving liquid material and defining an interior. An air impeller housing has an opening in air flow communication with the tank interior, and an air impeller is disposed inside the air impeller housing. A motor is disposed inside a motor housing and operatively coupled to the air impeller, and a switch is provided having a first position in which power is provided to the motor and a second position in which power to the motor is interrupted. A float is disposed in the tank and a float rod extends between the float and the switch, the float rod being capable of moving the switch from the first position to the second position. A seal is positioned intermediately along the float rod to create a water-tight barrier between opposite ends of the float rod.

Further in accordance with the teachings of the present invention, a vacuum cleaner is provided having a tank with an inlet for receiving liquid material and defining an interior. A lid closes a top of the tank, a motor housing is attached to the lid, and a motor is disposed inside the motor housing. A switch is disposed inside the motor housing and has a first position in which power is provided to the motor and a second position in which power to the motor is interrupted.

An air impeller is disposed in an air impeller housing defined by the motor housing and the lid, the air impeller housing having an opening in air flow communication with the tank interior and the air impeller being operatively coupled to the motor. A float is disposed in the tank, and a float rod extends between the float and the switch, the float rod being capable of moving die switch from the first position to the second position. A seal is supported by the motor housing and positioned intermediately along the float rod to create a water-tight barrier between opposite ends of the float rod.

Still further in accordance with the teachings of the present invention, a vacuum cleaner is provided having a tank with an inlet for receiving liquid material, the tank defining an interior. A lid closes a top of the tank, a motor housing is attached to the lid and includes a downwardly depending boss, and a motor is disposed inside the motor housing. A switch is disposed inside the motor housing and has a first position in which power is provided to the motor and a second position in which power to the motor is interrupted. An air impeller is disposed in an air impeller housing defined by the motor housing and the lid, the air impeller housing having an opening in air flow communication with the tank interior and the air impeller being operatively coupled to the motor. A float is disposed in the tank, and a float rod extends between the float and the switch, the float rod being capable of moving the switch from the first position to the second position. A seal is supported by the motor housing and positioned intermediately along the float rod to create a water-tight barrier between opposite ends of the float rod, and a hollow tube portion is attached to the lid and has an upper end sized to engage the motor housing boss, wherein the float rod passes through the tube portion.

Other features and advantages are inherent in the vacuum cleaner claimed and disclosed or will become apparent to those skilled in the art from the following detailed description in conjunction with the accompanying drawings.

DESCRIPTION OF THE PREFERRED EMBODIMENT

Figure 1:
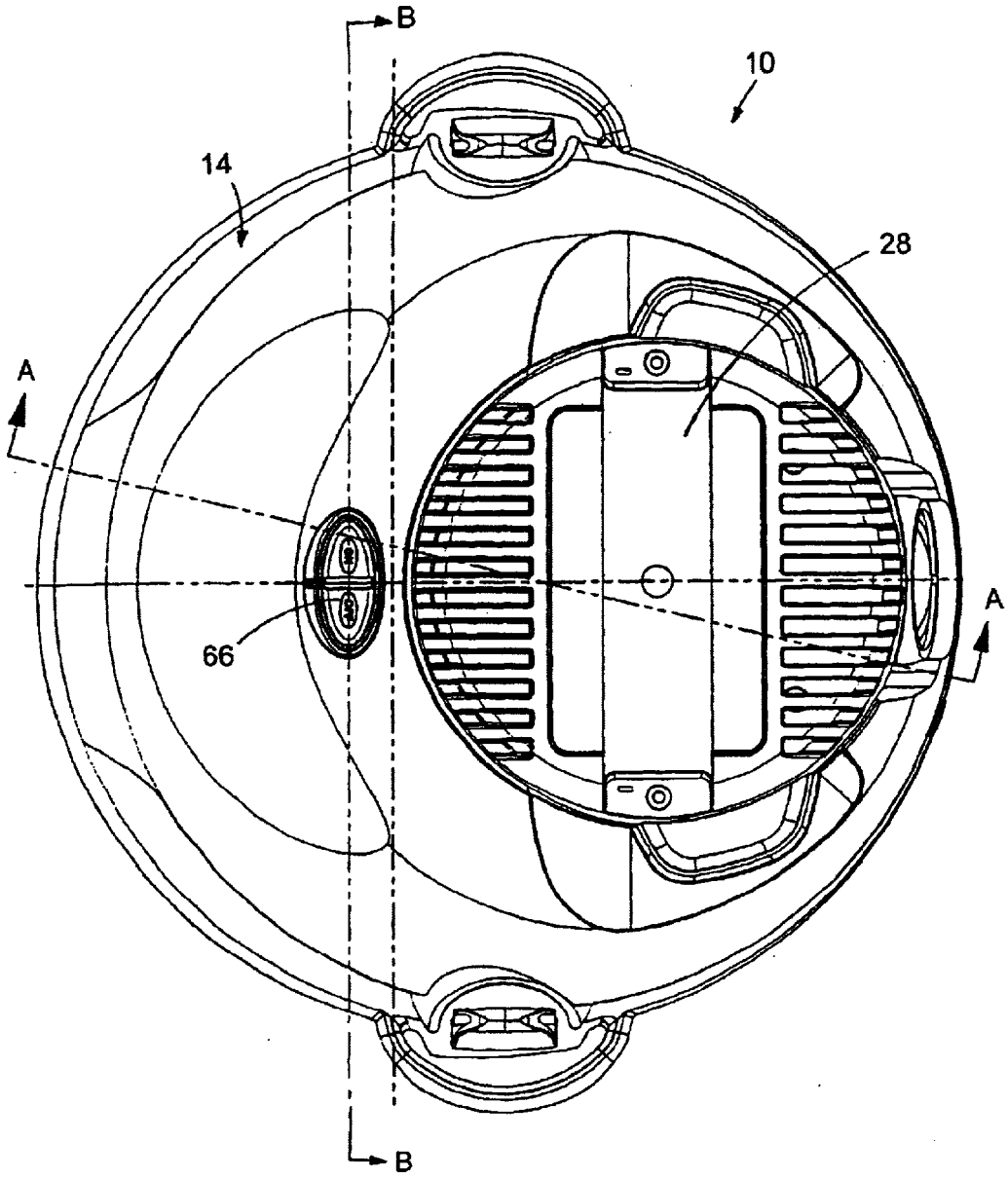
FIG. 1 is a top plan view of a vacuum cleaner in accordance with the teachings of the present invention.
Figure 2:
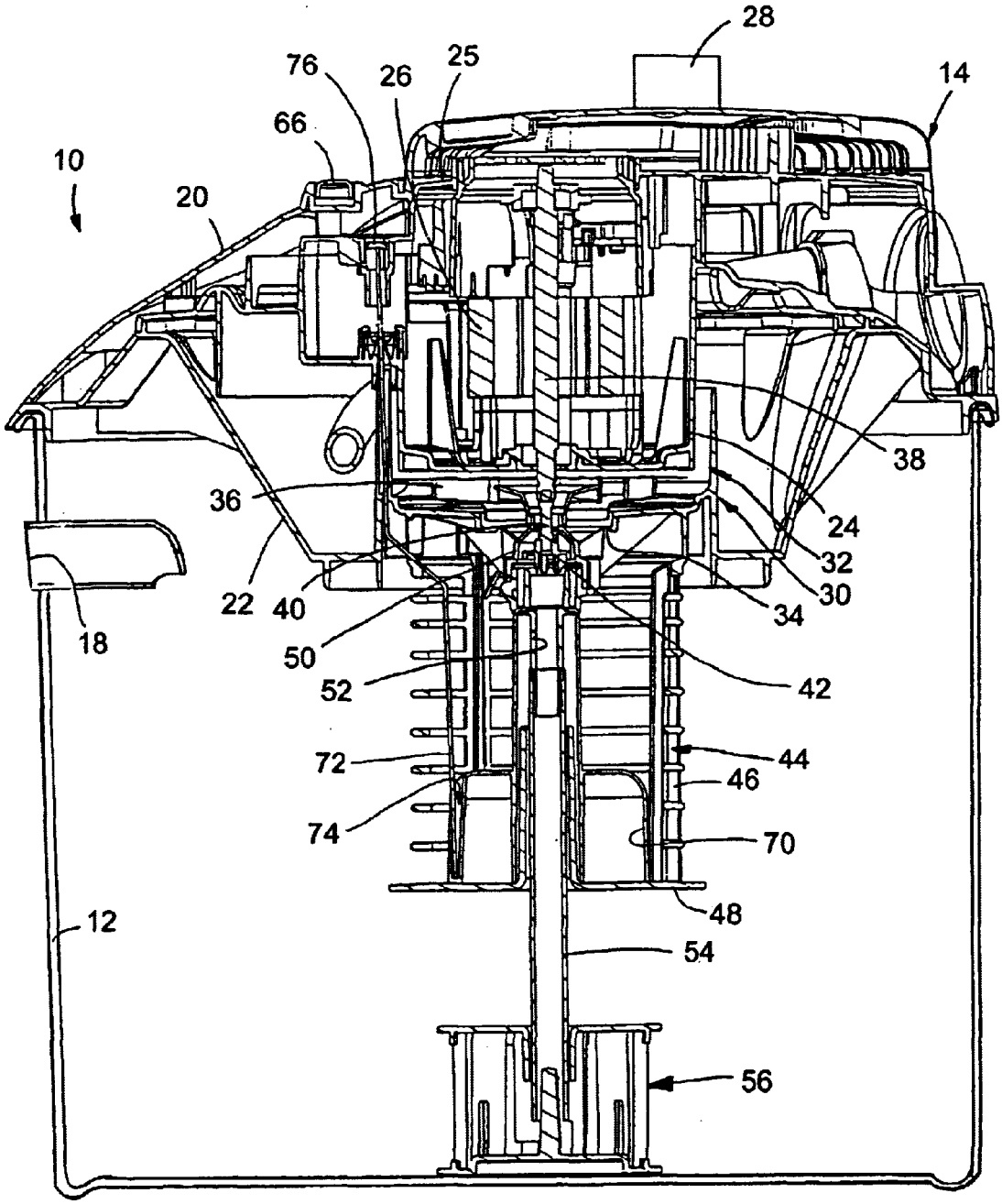
FIG. 2 is a side elevation view, partially in section, taken along line A—A in FIG. 1.
Figure 3:
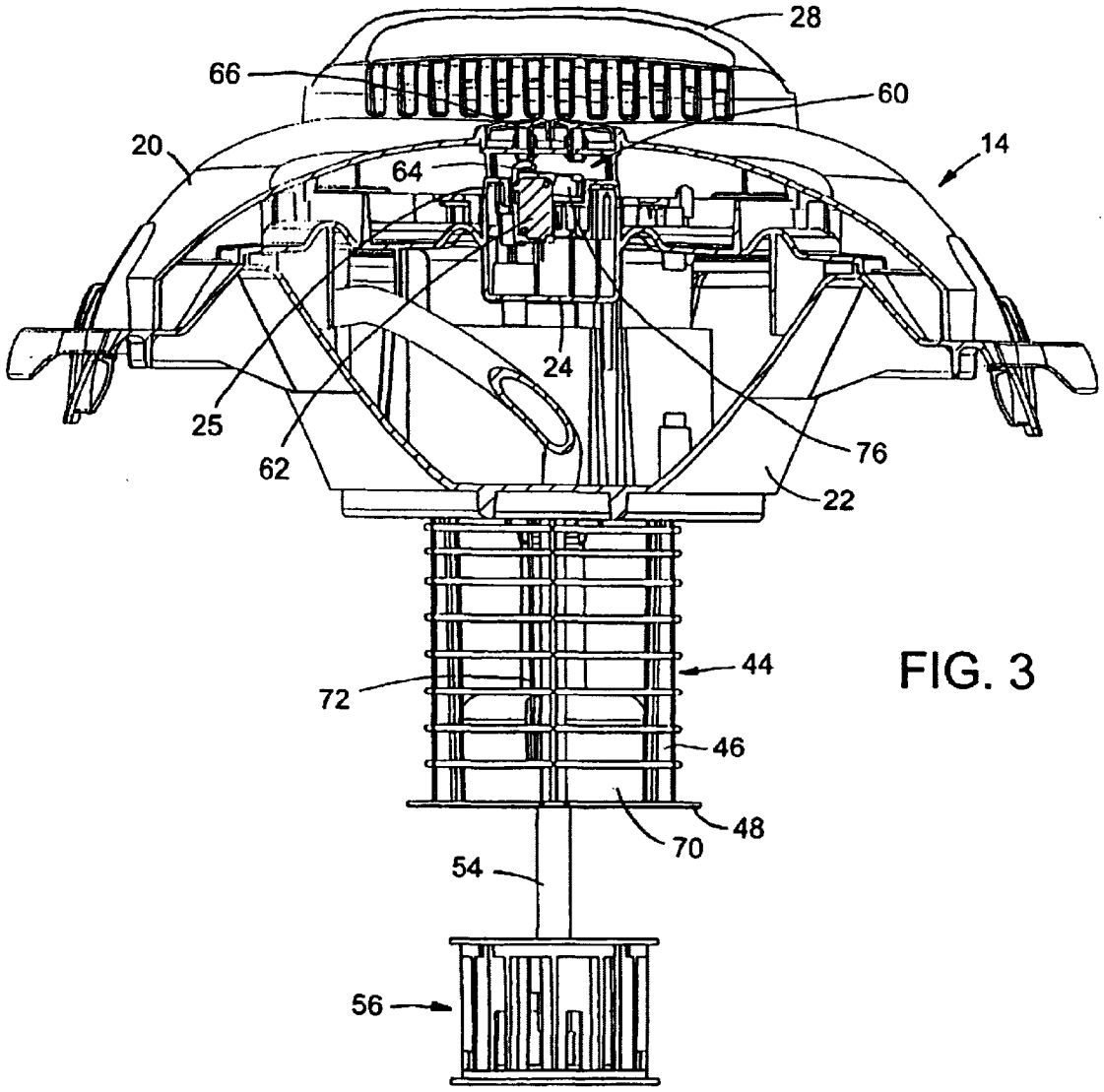
FIG. 3 is a side elevation view, partially in section, taken along line B—B in FIG. 1, with the tank removed.

Referring initially to FIGS. 1 and 2, a vacuum cleaner of the present invention, indicated generally at 10, has a tank 12 and an upper vacuum assembly, indicated generally at 14. The tank 12 includes a pair of handles (not shown), which may be used to assist the user in lifting and moving the vacuum cleaner 10. The tank 12 further defines an inlet 18 that may be fitted with a vacuum hose (not depicted) for applying suction at desired locations.

The upper vacuum assembly 14 includes a lid 22 releasably attached to the tank 12. Attached to the lid are a cover 20, a motor housing 24, and a baffle 25. A motor 26 is disposed inside the motor housing 24. The lid 22 makes up the bottom of the upper vacuum assembly 14 and may carry one or more latches (not shown) for attaching the upper vacuum assembly 14 to the tank 12. The motor housing 24 is disposed between the lid 22 and the cover 20. When a user wishes to connect the upper vacuum assembly 14 to the tank 12, the user lifts the upper vacuum assembly 14 above the tank 12, aligns the latches with latch recesses (not shown) formed in the tank, lowers the upper vacuum assembly 14 until the lid 22 rests on top of the tank 12, and then, fastens the latches to the tank 12. A handle 28 is provided on the upper vacuum assembly for facilitating transportation of the assembled vacuum cleaner 10.

Disposed in the upper vacuum assembly 14, among other things, is an air impeller assembly 30. The air impeller assembly 30 includes an impeller housing 32 defining an opening 34, an air impeller 36, a motor shaft 38 extending from the motor 26, and a shaft extension 40. (If desired, the vacuum cleaner 10 may alternatively use multiple air impellers.) In the illustrated embodiment, the air impeller housing 32 is defined by a lower portion of the motor housing 24 and a central portion of the lid 22, as best shown in FIG. 2. The air impeller 36 is disposed within the impeller housing 32.

The shaft extension 40 is secured to the motor shaft 38. From the motor shaft 38, the shaft extension 40 extends through the opening 34 of the housing 32 and connects to a pump impeller 42. As such, the motor 26 supports the air impeller 36 and the pump impeller 42 and drives both via the motor shaft 38 and the shaft extension 40. Alternatively, the shaft extension 40 may be formed integral with the motor shaft 38 so that a unitary structure drives the air impeller 36 and the pump impeller 42. Another alternative is for the shaft extension 40 to be offset from the motor shaft 38, and torque is then transferred from the motor shaft 38 to the shaft extension 40 via a transmission or a gear train.

Referring to FIG. 2, the upper vacuum assembly 14 also includes a filter cage 44 which may be integrally formed with or fastened to the lid 22 and extends downward therefrom. The air impeller assembly 30 is in fluid communication with the filter cage 44 so that the air impeller 36 draws air through the filter cage 44. The filter cage 44 includes several braces 46 that support a bottom plate 48. One or more filters (not shown) may surround the circumference of the filter cage 44 as needed during dry and wet pickup.

The pump impeller 42 is disposed in a pump housing 50 (FIG. 2). A housing inlet 52 is connected to an inlet tube 54 leading to a fluid inlet filter assembly 56. The pump impeller 42 may be primed using any known priming mechanism or arrangement, such as those described in commonly assigned U.S. Pat. Nos. 5,920,955, 6,119,304, and 6,226,831, incorporated herein by reference. The vacuum cleaner 10 further includes an outlet for discharging liquid transported by the pump, as described in greater detail in the '955, '304, and '831 patents incorporated herein.

In the illustrated embodiment, a switch actuation assembly 60 is disposed inside the motor housing 24 and includes a switch 62 and a toggle member 64. The switch 62 and toggle 64 are similar to those disclosed in commonly assigned U.S. Pat. No. 5,918,344, incorporated herein by reference, and therefore are not described in detail. The switch 62 has a first position in which power is provided to the motor 26 and a second position in which power to the motor is interrupted. The toggle member 64 engages the switch and is operable to place the switch in either the first or the second position. A user engagable switch actuator 66 is provided on an outside of the lid 20 for initially placing the switch 62 in the first or second position.

While, in the illustrated embodiment, the switch actuation assembly 60 (including the switch 62 and toggle member 64) is disposed in the motor housing 24, the assembly 60 may be located in other portions of the vacuum cleaner 10. For example, the switch actuation assembly may be enclosed by the baffle 25, a separate switch housing, or any other suitable location.

A high liquid level override assembly is provided for automatically stopping operation of the air impeller 36 in response to a high liquid level. The override assembly includes a float 70 disposed in the cage 44 and a float rod 72 that passes through the lid 22 and motor housing 24 to provide a linkage between the switch actuation assembly 60 and the float 70. The float 70 is hollow and may be made of any suitable material, such as copolymer polypropylene. The float 70 defines a rod receptacle 74 in which the float rod 72 sits.

In operation, if the level of liquid in the tank 12 gets too high, the high level override assembly will automatically shut-off the motor 26. When the liquid in the tank 12 gets to the level of the float 70, the liquid pushes the float 70 upward. Simultaneously, the float 70 pushes the float rod 72 upward against a rod receiving extension 76 of the toggle member 64. Eventually, the rising liquid reaches a level high enough to create an upward force so that the float rod 72 pushes the toggle 64 so that the switch 62 is in the second position, which stops the motor 26 and, consequently, stops the air impeller 36 and the pump impeller 42 from rotating. The float 70 should be placed at a height low enough so that the motor 26 is turned "OFF" before the level of liquid is high enough to begin entering the air impeller 36.

Figure 4:
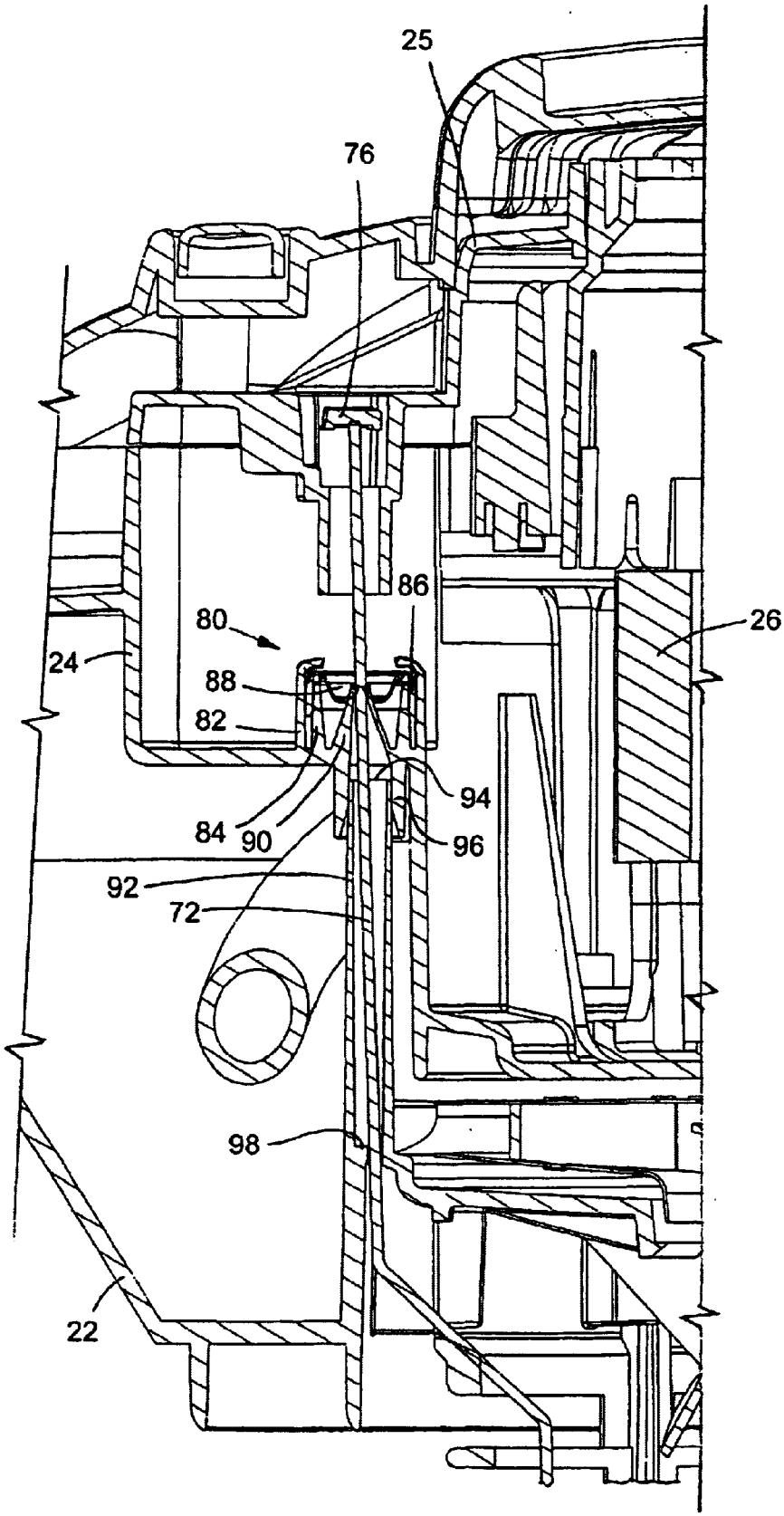
FIG. 4 is an enlarged side elevation view, partially in section, of a portion of FIG. 2 showing the float rod seal.

In accordance with certain aspects of the present invention, a float rod seal 80 is provided to prevent liquid from traveling along the float rod path. As best shown in FIG. 4, the motor housing 24 is formed with an outer upwardly extending wall 82 and an inner upwardly extending wall 84. The outer and inner upwardly extending walls 82, 84 are spaced to define an annular gap 86 therebetween. A flexible diaphragm 88 has an outer diameter inserted into the annular gap 86 that is sufficiently thick so that it is frictionally held between the walls 82, 84. An upper portion of the outer wall 82 may be crimped inwardly to retain the diaphragm 88 in place. An inner portion of the diaphragm 88 is formed with an aperture sized to engage the float rod 72 to form a water-tight seal therebetween. As shown in FIG. 4, the diaphragm 88 may be curved to accommodate vertical movement of the float rod 72. The motor housing 24 may further be formed with an upwardly projecting seat 90 having an upper end engaging a bottom surface of the diaphragm 88. With the float rod seal 80 in place, liquid from the tank 12 is prevented from entering the motor housing 24 along the path followed by the float rod 72.

Figure 5:
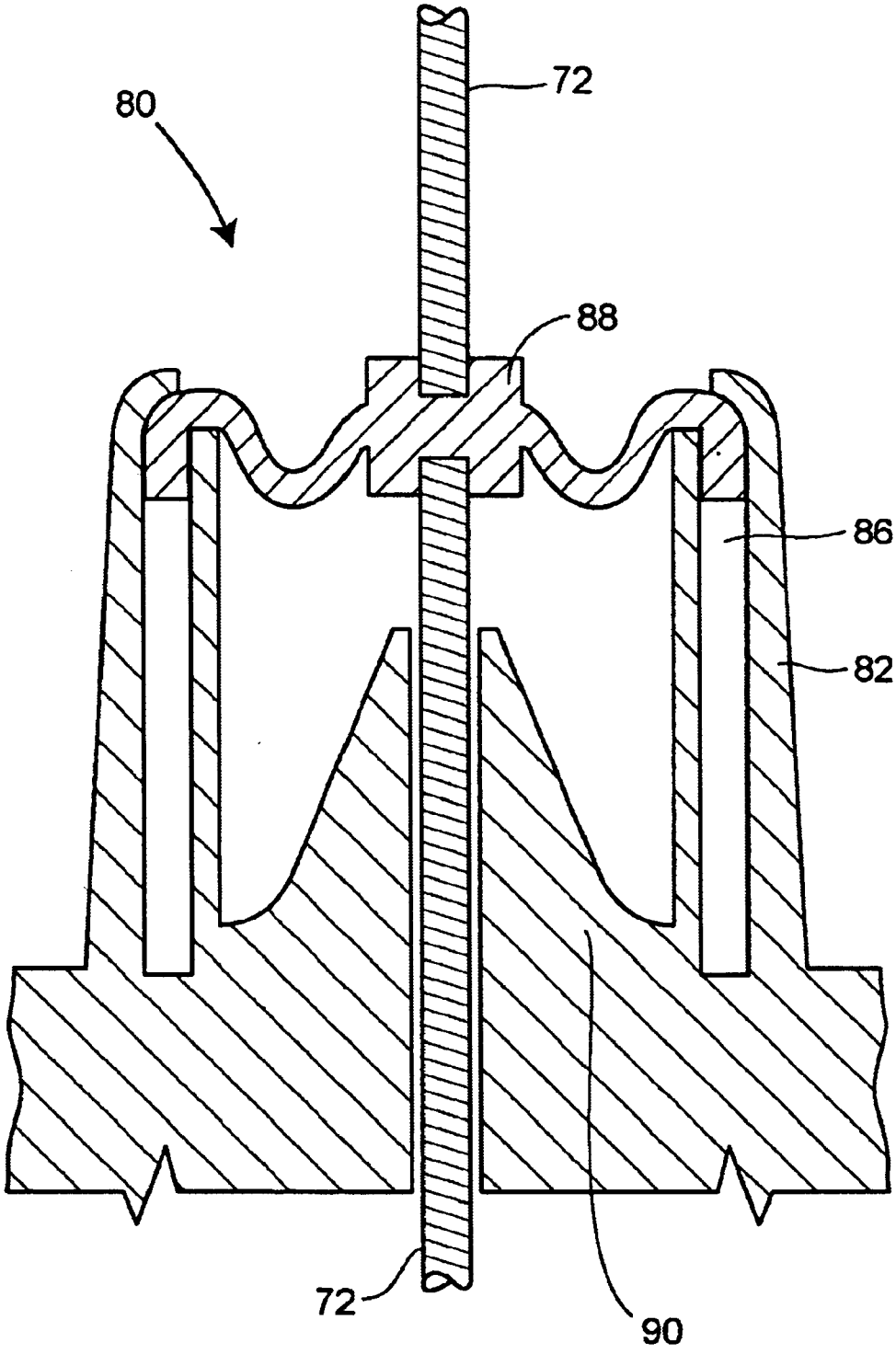
FIG. 5 is an enlarged side elevation in section, of an alternate embodiment of a diaphragm as shown in FIG. 4.

While, in the illustrated embodiment, the float rod 72 comprises a single rod that is engaged by the diaphragm 88, it will be appreciated that other seal arrangements may be provided. For example, as illustrated in FIG. 5, the float rod 72 may be formed of a first rod extending below the diaphragm 88 to the float 70, and a second rod extending above the diaphragm to the switch 62. The first and second rods are attached to opposite surfaces of the diaphragm 88, which may be continuous (i.e., does not include an aperture as in the previous embodiment). As a result, movement of the first rod is transferred through the diaphragm 88 to the second rod, and the diaphragm 88 provides an uninterrupted seal between the rods.

To further prevent liquid from traveling into the motor housing 24 and to reduce the exposure of the float rod 72 to liquid from the air impeller 36, the lid 22 is provided with a hollow tube portion 92. The tube portion 92 extends from a bottom surface of the lid to an upper end 94 positioned near the motor housing 24. The motor housing 24 is preferably formed with a downwardly depending boss 96 having an inner diameter sized to frictionally receive the tube portion upper end 94. The tube portion 92 has an inner diameter sufficient to receive the float rod 72 without restricting vertical travel of the rod. A bottom end of the tube portion 92 may be formed with a neck 98 sized to more closely fit the float rod 72, thereby to reduce the amount of liquid passing into the tube portion 92. As a result, a portion of the float rod 72 located near the air impeller 36 is entirely enclosed, thereby preventing liquid which may be expelled from the air impeller 36 from following the float rod path to the motor housing.

The foregoing detailed description has been given for clearness of understanding only, and no unnecessary limitations should be understood therefrom, as modifications would be obvious to those skilled in the art.

We claim:

1. A vacuum cleaner comprising:

a tank having an inlet for receiving liquid material, the tank defining an interior;

an air impeller housing having an opening in air flow communication with the interior;

an air impeller disposed inside the air impeller housing;

a motor disposed inside a motor housing and operatively coupled to the air impeller;

a switch having a first position in which power is provided to the motor and a second position in which power to the motor is interrupted;

a float disposed in the tank;

a float rod extending between the float and the switch, the float rod being capable of moving the switch from the first position to the second position; and a seal attached intermediately along and to the float rod to create a water-tight barrier between opposite ends of the float rod, at least a portion of the seal being adapted to travel with the float rod.

2. The vacuum cleaner of claim 1, in which the switch is disposed inside the motor housing.

3. The vacuum cleaner of claim 2, in which the seal comprises a flexible diaphragm supported by the motor housing.

4. The vacuum cleaner of claim 3, in which the float rod passes through a wall separating the switch from the float, wherein the diaphragm is supported by the wall.

5. The vacuum cleaner of claim 4, in which the wall forms at least a portion of the motor housing.

6. The vacuum cleaner of claim 1, in which a toggle member engages the switch to move the switch to the first and second positions.

7. The vacuum cleaner of claim 6, in which the toggle member includes an extension adapted to engage the float rod.

8. A vacuum cleaner comprising:

a tank having an inlet for receiving liquid material, the tank defining an interior;

a lid attached to the tank;

an air impeller housing having an opening in air flow communication with the tank interior, the impeller housing being defined by a space between the motor housing and the lid;

an air impeller disposed inside the air impeller housing;

a motor disposed inside a motor housing and operatively coupled to the air impeller;

a switch having a first position in which power is provided to the motor and a second position in which power to the motor is interrupted;

a float disposed in the tank;

a float rod extending between the float and the switch, the float rod being capable of moving the switch from the first position to the second position;

a boss depending from the motor housing, wherein the lid includes a tube portion having an upper end sized to engage the boss, and a portion of the float rod passes through the tube portion; and a seal positioned intermediately along the float rod to create a water-tight barrier between opposite ends of the float rod.

9. A vacuum cleaner comprising:

a tank having an inlet for receiving liquid material, the tank defining an interior;

a lid for closing a top of the tank;

a motor housing attached to the lid;

a motor disposed inside the motor housing;

a switch disposed inside the motor housing and having a first position in which power is provided to the motor and a second position in which power to the motor is interrupted;

an air impeller disposed in an air impeller housing defined by the motor housing and the lid, the air impeller housing having an opening in air flow communication with the interior and the air impeller being operatively coupled to the motor;

a float disposed in the tank;

a float rod extending between the float and the switch, the float rod being capable of moving the switch from the first position to the second position; and a seal supported by the motor housing and attached intermediately along and to the float rod to create a water-tight barrier between opposite ends of the float rod, at least a portion of the seal being adapted to travel with the float rod.

10. The vacuum cleaner of claim 9, in which the motor housing includes inner and outer upwardly projecting walls defining an annular space therebetween, and in which the seal comprises a flexible diaphragm having an outer edge inserted into the annular space and sized so that the inner and outer upwardly projecting walls frictionally hold the outer edge of the diaphragm.

11. The vacuum cleaner of claim 10, in which an upper portion of the outer upwardly projecting wall is crimped inwardly to retain the diaphragm.

12. The vacuum cleaner of claim 10, in which the motor housing further includes an upwardly projecting seat adapted to engage an inner portion of the diaphragm.

13. The vacuum cleaner of claim 9, in which a toggle member engages the switch to move the switch to the first and second positions.

14. The vacuum cleaner of claim 13, in which the toggle member includes an extension adapted to engage the float rod.

15. A vacuum cleaner comprising:

a tank having an inlet for receiving liquid material, the tank defining an interior;

a lid for closing a top of the tank, the lid including a tube portion having an upper end sized to engage a boss;

a motor housing attached to the lid, the motor housing including the boss, the boss being downwardly depending from the motor housing;

a motor disposed inside the motor housing;

a switch disposed inside the motor housing and having a first position in which power is provided to the motor and a second position in which power to the motor is interrupted;

an air impeller disposed in an air impeller housing defined by the motor housing and the lid, the air impeller housing having an opening in air flow communication with the tank interior and the air impeller being operatively coupled to the motor;

a float disposed in the tank;

a float rod extending between the float and the switch, the float rod being capable of moving the switch from the first position to the second position, wherein a portion of the float rod passes through the tube portion; and a seal supported by the motor housing and positioned intermediately along the float rod to create a water-tight barrier between opposite ends of the float rod.

16. A vacuum cleaner comprising:

a tank having an inlet for receiving liquid material, the tank defining an interior;

a lid for closing a top of the tank, the lid including a tube portion having an upper end sized to engage a boss;

a motor housing attached to the lid, the motor housing including the boss, the boss being downwardly depending from the motor housing;

a motor disposed inside the motor housing;

a switch disposed inside the motor housing and having a first position in which power is provided to the motor and a second position in which power to the motor is interrupted;

an air impeller disposed in an air impeller housing defined by the motor housing and the lid, the air impeller housing having an opening in air flow communication with the tank interior and the air impeller being operatively coupled to the motor;

a float disposed in the tank;

a float rod extending between the float and the switch, the float rod being capable of moving the switch from the first position to the second position, wherein a portion of the float rod passes through the tube portion; and a seal supported by the motor housing and positioned intermediately along the float rod to create a water-tight baffler between opposite ends of the float rod.

17. The vacuum cleaner of claim 16, in which the motor housing includes inner and outer upwardly projecting walls defining an annular space therebetween, and in which the seal comprises a flexible diaphragm having an outer edge inserted into the annular space and sized so that the inner and outer upwardly projecting walls frictionally hold the outer edge of the diaphragm.

18. The vacuum cleaner of claim 17, in which an upper portion of the outer upwardly projecting wall is crimped inwardly to retain the diaphragm.

19. The vacuum cleaner of claim 17, in which the motor housing further includes an upwardly projecting seat adapted to engage an inner portion of the diaphragm.

20. The vacuum cleaner of claim 16, in which the seal includes an aperture through which the float rod passes, the aperture being sized to create a water-tight engagement with the float rod.

21. The vacuum cleaner of claim 16, in which a toggle member engages the switch to move the switch to the first and second positions.

22. The vacuum cleaner of claim 21, in which the toggle member includes an extension adapted to engage the float rod.

* * * * *